US006786344B2

(12) United States Patent
Kipperman et al.

(10) Patent No.: US 6,786,344 B2
(45) Date of Patent: Sep. 7, 2004

(54) BABY BOTTLE

(75) Inventors: Stuart R. Kipperman, Evansville, IN (US); David Schweitzer, Weston, CT (US); Catherine O. Smay, Newburgh, IN (US)

(73) Assignee: Bristol-Myers Squibb Company, Princeton, NJ (US)

( * ) Notice: Subject to any disclaimer, the term of this patent is extended or adjusted under 35 U.S.C. 154(b) by 0 days.

(21) Appl. No.: 10/217,685

(22) Filed: Aug. 13, 2002

(65) Prior Publication Data

US 2003/0226816 A1 Dec. 11, 2003

Related U.S. Application Data

(63) Continuation-in-part of application No. 29/162,124, filed on Jun. 10, 2002.

(51) Int. Cl.[7] ..... A61J 9/00

(52) U.S. Cl. ..... 215/11.1; 215/384; 426/117

(58) Field of Search ..... 215/11.1, 252, 215/384, 398, 11.2–11.6, 382; 426/117; D24/197

(56) References Cited

U.S. PATENT DOCUMENTS

| | | | | | |
|---|---|---|---|---|---|
| 1,610,136 | A | * | 12/1926 | Kelty | 215/11.1 |
| 1,947,753 | A | * | 2/1934 | Block | 215/11.1 |
| D99,270 | S | | 4/1936 | Dache-Despres | |
| D105,669 | S | | 8/1937 | Mills | |
| D189,373 | S | | 11/1960 | Lerner | |
| D198,870 | S | | 8/1964 | Hedgcock | D58/8 |
| 3,145,867 | A | * | 8/1964 | Roberts et al. | 215/11.1 |
| 3,162,318 | A | | 12/1964 | Woodbury, Jr. | 215/11 |
| D202,003 | S | | 8/1965 | Douglas | D58/17 |
| 3,243,069 | A | | 3/1966 | Duerme | 215/11 |
| D209,715 | S | | 12/1967 | Ninesling et al. | D58/8 |
| D218,148 | S | | 7/1970 | Noyes et al. | D9/118 |
| 3,645,262 | A | | 2/1972 | Harrigan | 604/77 |
| D223,438 | S | | 4/1972 | Lluch | D9/169 |
| D225,212 | S | | 11/1972 | Mandiargues | D9/169 |
| 3,746,198 | A | * | 7/1973 | Howland | 215/11.1 |
| D230,256 | S | | 2/1974 | Ckola | D9/102 |
| 3,804,952 | A | * | 4/1974 | Mac Donald | 215/11.1 X |
| 3,838,784 | A | * | 10/1974 | Barton et al. | 215/11.1 |

(List continued on next page.)

FOREIGN PATENT DOCUMENTS

| | | | | |
|---|---|---|---|---|
| FR | 2576686 | * | 8/1986 | 215/11.1 |
| WO | WO 88/04261 | | 6/1988 | |

OTHER PUBLICATIONS

International Search Report of Aug. 27, 2003.

*Primary Examiner*—Sue A. Weaver
(74) *Attorney, Agent, or Firm*—Nelson Mullins Riley & Scarborough, LLP

(57) ABSTRACT

A baby bottle including an upper and lower circular shaped cylindrical body portion having a first radius, a elliptical shaped cylindrical body portion intermediate the cylindrical upper and lower body portions, where the center portion has a minor axis radius and a major axis radius that are each smaller than the first radius, and a cylindrical top portion located proximate the upper body portion and adapted to receive a removable closure.

26 Claims, 4 Drawing Sheets

U.S. PATENT DOCUMENTS 4,010,861 A 3/1977 Welten ..... 215/11 B
D250,248 S 11/1978 Grip ..... D9/44
D251,612 S 4/1979 Lagergren et al. ..... D24/47
D253,395 S 11/1979 Hasegawa et al. ..... D9/131
D255,653 S 7/1980 Lipsz ..... D9/158
D255,989 S 7/1980 Lipsz ..... D9/131
D264,051 S 4/1982 Perales ..... D9/404
D269,950 S 8/1983 Walker ..... D9/400
D275,231 S 8/1984 Fuller ..... D24/47
4,502,607 A 3/1985 Szajna ..... 220/70
D279,650 S 7/1985 Aldrich, III et al. ..... D9/377
D279,654 S 7/1985 Grip et al. ..... D9/404
D282,050 S 1/1986 Beaver et al.
4,676,387 A 6/1987 Stephenson et al. ..... 215/11 R
4,703,863 A 11/1987 Kohus ..... 215/11.1
4,750,630 A 6/1988 Campbell et al. ..... 215/11.1
D298,354 S 11/1988 Viator ..... D24/47
D300,118 S 3/1989 Venne et al. ..... D9/350
4,813,556 A * 3/1989 Lawrence ..... 215/11.1 X
D300,511 S 4/1989 Cramer ..... D9/396
4,830,251 A * 5/1989 Conrad ..... 215/11.1 X
4,832,213 A * 5/1989 Sharon et al. ..... 215/11.1
4,832,917 A 5/1989 Elliott ..... 422/102
D301,741 S 6/1989 Barber ..... D24/47
D302,038 S 7/1989 Barber ..... D24/47
D304,996 S 12/1989 Hollenberg et al. ..... D9/338
4,923,088 A 5/1990 Tanaka et al. ..... 220/23.87
D308,575 S 6/1990 Mariol ..... D24/47
D309,948 S 8/1990 Chambers ..... D24/47
D310,779 S 9/1990 Gloeckler ..... D9/377
D312,878 S 12/1990 Mariol ..... D24/47
D313,075 S 12/1990 Mariol ..... D24/47
D315,212 S 3/1991 Oknuki ..... D24/47
D315,213 S 3/1991 Ohnuki ..... D24/47
D315,409 S 3/1991 Baarber ..... D24/47
D317,121 S 5/1991 Crawford et al. ..... D9/367
D317,256 S 6/1991 Samuels ..... D9/355
D320,455 S 10/1991 Malcolm ..... D24/199
D321,936 S 11/1991 Donovan ..... D24/197
D325,167 S 4/1992 Humfress ..... D9/403
5,112,628 A * 5/1992 Conrad ..... 215/11.1 X
D327,005 S 6/1992 Beeman ..... D9/500
5,158,817 A 10/1992 Krishnakumar ..... 428/36.92
D333,435 S 2/1993 Blair ..... D9/542
5,183,229 A * 2/1993 Duggan ..... 215/11.1 X
D333,704 S 3/1993 Malcolm ..... D24/194
D333,789 S 3/1993 Reif ..... D9/563
D335,450 S 5/1993 Pezzoli et al. ..... D9/500
5,217,737 A 6/1993 Gygax et al. ..... 426/111
D337,271 S 7/1993 Pezzoli et al. ..... D9/503
D337,939 S 8/1993 Smith, Jr. ..... D9/338
5,234,126 A 8/1993 Jonas et al. ..... 220/609
5,263,599 A 11/1993 Sklar ..... 215/11.1
5,269,437 A 12/1993 Gygax et al. ..... 220/606
D343,793 S 2/1994 Crawford ..... D9/529
D345,376 S 3/1994 Underwood, Jr. ..... D19/48
D346,744 S 5/1994 Ford et al. ..... D9/542
D346,963 S 5/1994 Crawford ..... D9/550
5,316,160 A 5/1994 Cautereels ..... 215/11.1
D352,242 S 11/1994 Crawford et al. ..... D9/529
D354,913 S 1/1995 Pezzoli et al. ..... D9/500
D356,160 S 3/1995 Cautereels ..... D24/197
D362,800 S 10/1995 Sherman et al. ..... D9/341
D368,035 S 3/1996 Ahern, Jr. ..... D9/556
D368,528 S 4/1996 Allegre ..... D24/197
5,531,338 A 7/1996 Sklar ..... 215/11.1
5,680,945 A * 10/1997 Sander et al. ..... 215/252
D386,413 S 11/1997 Fitten et al. ..... D9/503
D386,687 S 11/1997 Fitten et al. ..... D9/504
D387,988 S 12/1997 Fitten et al. ..... D9/504
D389,865 S 1/1998 Venne et al. ..... D19/48
5,713,681 A 2/1998 Venne et al. ..... 401/202
D396,191 S 7/1998 Kuzma et al. ..... D9/574
D396,244 S 7/1998 Venne et al. ..... D19/43
D397,444 S 8/1998 Ibey ..... D24/197
5,807,156 A 9/1998 Owen ..... 446/77
D399,756 S 10/1998 Lonczak et al. ..... D9/574
D404,491 S 1/1999 Scott ..... D24/197
D404,493 S 1/1999 Varlet ..... D24/197
D405,373 S 2/1999 Crawford ..... D9/543
D413,518 S 9/1999 Rodea ..... D9/538
D415,685 S 10/1999 Braun ..... D9/503
D420,448 S 2/2000 Brown et al. ..... D24/197
6,039,204 A 3/2000 Hosokoshiyama et al. .. 220/623
D423,107 S 4/2000 Brown et al. ..... D24/197
D426,161 S 6/2000 Hestehave et al. ..... D9/520
6,095,705 A 8/2000 Phillips ..... 401/6
D432,022 S 10/2000 Meeker et al. ..... D9/548
6,138,847 A * 10/2000 Johnson ..... 215/11.1
D433,637 S 11/2000 Hailey et al. ..... D9/542
6,171,623 B1 * 1/2001 Gaylor et al. ..... 215/11.1 X
D443,821 S 6/2001 Bakic ..... D9/500
D443,828 S 6/2001 Meeker et al. ..... D9/540
D444,390 S 7/2001 Kokenge et al. ..... D9/542
D445,692 S 7/2001 Meeker et al. ..... D9/530
D446,127 S 8/2001 Adee et al. ..... D9/563
D446,128 S 8/2001 Adee et al. ..... D9/563
2001/0022291 A1 9/2001 Shimada et al. ..... 215/382

* cited by examiner

BABY BOTTLE

CLAIM OF PRIORITY

This application is a continuation-in-part of U.S. Design application Ser. No. 29/162,124, filed with the U.S. Patent Office on Jun. 10, 2002.

FIELD OF THE INVENTION

The present invention relates to the field of baby bottle constructions in general, and more particularly to an ergonomically designed baby bottle.

BACKGROUND OF THE INVENTION

As can be seen by reference to the following U.S. Pat. Nos. D356,160, D337,271, D335,450, D420,448, D423,107, 3,145,867, 4,676,387, 4,703,863, 5,263,599, 5,316,160, 5,531,338, and 5,807,156, the prior art is replete with varying baby bottle sizes and constructions. Some of these are configured to facilitate washing, with little or no consideration given to the need for the caregiver to hold the bottle. Still others appear to be configured to facilitate holding of the bottle by an infant. Most, if not all, bottles neglect the special needs that arise when feeding premature infants.

While the prior art constructions may be adequate for the basic purpose and function for which they have been specifically designed, they are uniformly deficient with respect to their failure to provide a simple, efficient, and practical premature infant feeding bottle. In particular, the prior art fails to disclose a bottle sized and constructed to (1) allow a care giver to hold the infant and bottle in the same hand during the feeding process, (2) enhance a caregiver's grasp of the bottle and comfort while gripping the bottle, (3) increase control during the feeding process, and (4) simplify the feeding process.

Moreover, given the recent increase in multiple birth events attributable to both fertility drugs and in vitro techniques, a problem has arisen for those parents who are faced with feeding multiple newborns at regular intervals. As a consequence of the foregoing situation, a need has arisen for a new and improved ergonomically designed baby bottle construction that will simplify the feeding process and substantially reduce the wrist fatigue experienced by parents and caregivers who spend hours a day coping with multiple infant feedings or the feeding of premature infants.

SUMMARY OF THE INVENTION

The present invention recognizes and addresses disadvantages of prior art constructions and methods, and it is an object of the present invention to provide an improved baby bottle.

This and other objects may be achieved by a baby formula bottle including an upper and lower circular shaped cylindrical body portion having a first radius, and a central elliptical shaped cylindrical body portion intermediate the circular shaped cylindrical upper and lower body portions, where the center portion has a minor axis and a major axis radius that are each smaller than the first radius. The bottle also includes a cylindrical top portion located proximate the upper body portion and that is adapted to receive a removable closure. The cylindrical top portion further includes a first helical thread formed on its outer circumference, a top rim surface, and an annular flange on the outer circumference and axially located below the first helical thread. A plurality of frangible breakaway tongues may removably attach an anti-tamper ring to the bottom rim of the closure. The ring also has radially inwardly extending ridges for engaging a bottom surface of the annular flange, whereby the ring removably secures the closure to the cylindrical top portion.

The closure includes an annular cap and an annular end wall defining an aperture therein. A nipple having a radially extending annular flange with a maximum outer radius substantially equal to the inner radius of the annular cap is press fit into the under side of the annular cap. A second helical thread formed on the inner circumference of the annular cap receives the first thread for removably securing the annular cap to the cylindrical top portion. Compressing the outer edge portion of the nipple flange between the bottom surface of the annular end wall and the top rim portion forms a liquid-tight seal as the closure is screwed onto the cylindrical top portion.

BRIEF DESCRIPTION OF THE DRAWINGS

A full and enabling disclosure of the present invention, including the best mode thereof directed to one of ordinary skill in the art, is set forth in the specification, which refers to the appended Figures, in which.

DETAILED DESCRIPTION OF THE INVENTION

Figure 1:
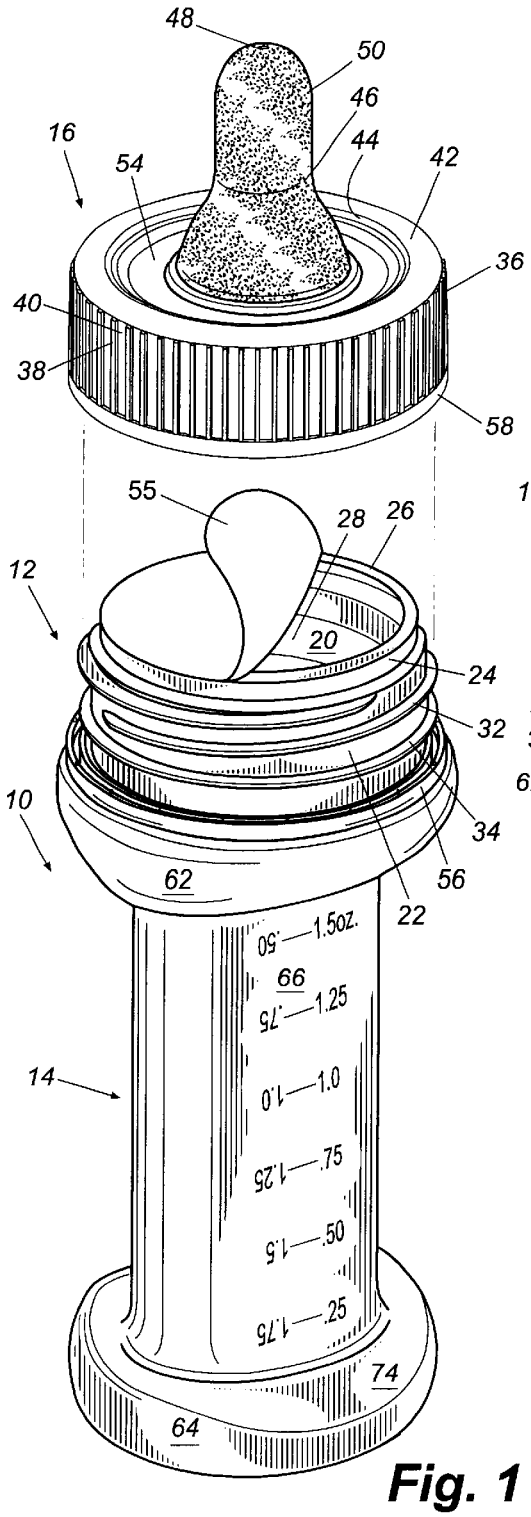
FIG. 1 is a perspective view of a baby bottle embodying the design of the present invention.

One of ordinary skill in the art will understand that the present discussion is a description of exemplary embodiments only, and is not intended as limiting the broader aspects of the present invention, which broader aspects are embodied in the exemplary construction. A repeat use of reference characters in the present specification and drawings represents the same or analogous features or elements of the invention.

With reference now to the drawings, and in particular to FIG. 1, an embodiment of the new and improved infant feeding bottle generally designated by the reference numeral 10 will be described. Bottle 10 includes a cylindrical top portion designated generally by the numeral 12, a body portion designated generally by the numeral 14, and a closure designated generally by the numeral 16. Cylindrical top portion 12 and body 14 may be integrally molded of a suitable plastic material, which may be blow molded, by extrusion or injection, so that it is a unitary member of uniform wall thickness. A suitable transparent plastic for forming the bottle includes, but is not limited to, polystyrene, polystyrene-acrylonitile, acrylonitile-butadiene-styrene, styrene-maleicanhydride, polycarbonate, polyethylene terephthalate, polyvinylcyclohexane, and blends thereof.

Figure 2:
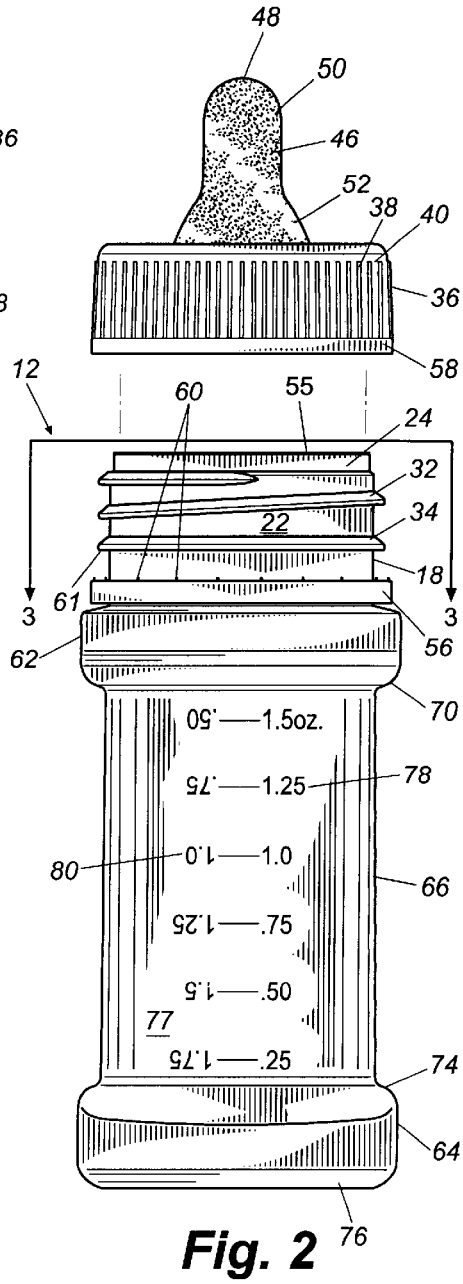
FIG. 2 is a front elevational view of the baby bottle illustrated in FIG. 1, the back elevational view being a mirror image of the front.
Figure 3:
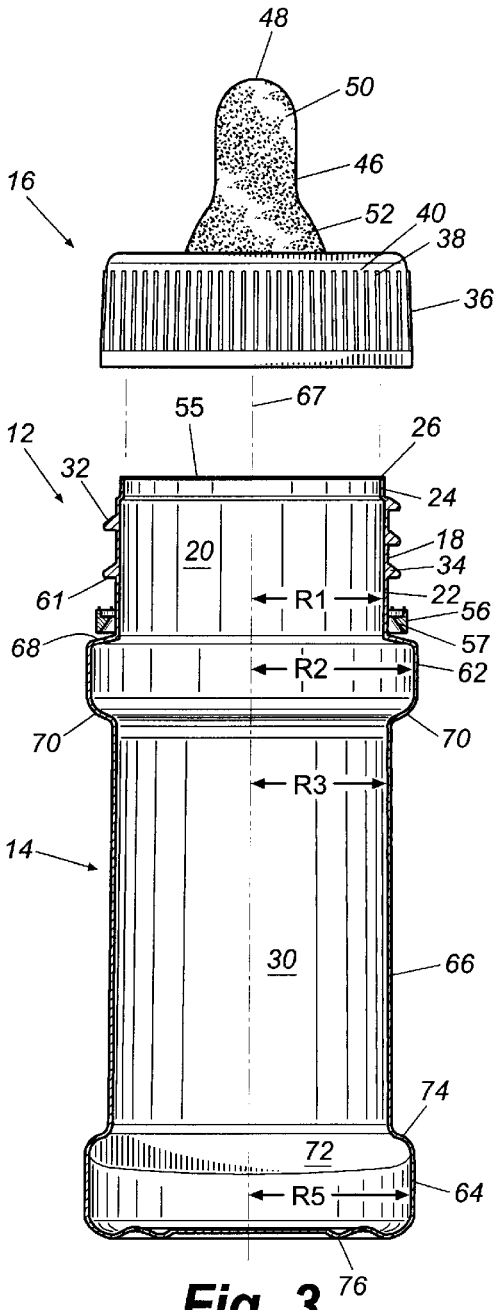
FIG. 3 is a front cross-sectional view along line 3—3 of the baby bottle shown in FIG. 2, the back cross-sectional view being a mirror image of the front.
Figure 4:
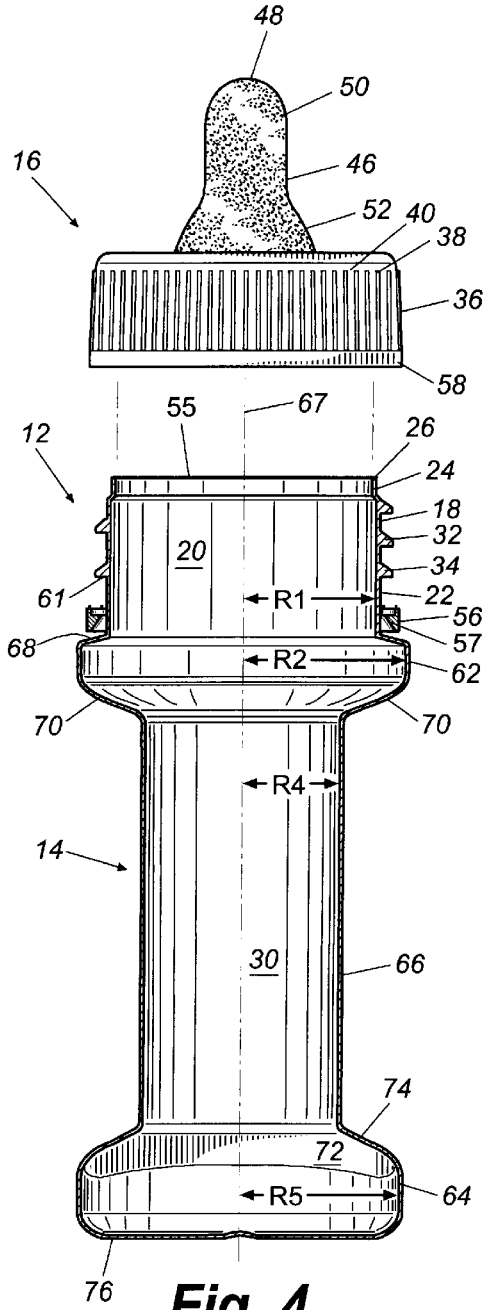
FIG. 4 is a right side cross-sectional view along line 4—4 of the baby bottle shown in FIG. 5, the left side cross-sectional view being a mirror image of the right side.

Referring to FIGS. 1 to 5, threaded cylindrical top portion 12 includes a cylindrical portion 18 having an outer circumference 22. As shown in FIGS. 3 and 4, radius R1 defines an inner circumference 20 of cylindrical portion 18. A mouth 24 and a rim 26 are integrally formed on cylindrical portion 18. Mouth 24 defines an aperture 28 in fluid communication with an inner chamber 30 of body 14. The mouth end is adapted for the removable receipt of closure 16. A helical thread 32 is integrally formed on outer circumference 22 of cylindrical portion 18 for removably securing closure 16 to cylindrical top portion 12. Helical thread 32 begins at a point where mouth 24 connects to cylindrical portion 18 and terminates proximate a flange 34.

As shown in FIG. 1, closure 16 includes an annular cap 36 having a helical thread (not shown) on its inner circumference for removably securing cap 36 to the externally threaded cylindrical top portion 12. Outer circumference 40 of annular cap 36 may contain ribs or knurling 38. Ribs 38 allow the caregiver to more easily grip closure 16 to remove it from or fit it on top portion 12. In addition to its internally threaded cylindrical wall, cap 36 includes an annular end wall 42 having an interior peripheral rim 44 dimensioned to fit into a groove (not shown) in a nipple 46. Nipple 46 and annular cap 36 can thus be press fit together to form closure 16.

Nipple 46 has a nearly flat or very shallowly curved surface 48 at the end of a mouthpiece 50. Nipple 46 widens out to a frustoconical section 52 located intermediate an annular flange 54 and mouthpiece 50. Annular flange 54 is dimensioned to seat on rim 26 of mouth 24, and it defines a central aperture, which is in fluid communication with aperture 28 and chamber 30. The aperture defined by annular flange 54 allows fluid to flow from body 14 into and through nipple 46. A soft pliable material such as conventional or silicone rubber may be used to form nipple 46.

Nipple 46 is press fit into annular cap 36 so that peripheral rim 44 engages the external annular groove in nipple 46. Thus, mouthpiece 50 and frustoconical portion 52 extend upward through annular cap 36 so that annular flange 54 engages a rearward surface of annular end wall 42. In this configuration, an outer most edge portion of annular flange 54 is in abutting contact with the inner, circumference of annular cap 36. Thus, threadably securing closure 16 onto threaded cylindrical portion 12 causes the rearward surface of annular end wall 42 to compress annular flange 54 against rim 26 to form a liquid-tight seal.

A releasable seal 55 attached to rim 26 over mouth 24 allows for vacuum packaging of the infant formula in bottle 10. One skilled in the art of baby formula or food packaging will be familiar with such releasably attached seals for vacuum packaging. Specifically, adhesive or heat attaches a seal formed of polyvinyl chloride, polystyrene, or other suitable material to mouth 24 to form an airtight seal. Therefore, removal of closure 16 will not disturb the vacuum seal unless the seal is cut or removed.

Formula may be prepackaged in bottle 10 with liquid or powdered infant formula, in particular, formula for premature babies. The packaged infant formula would be premeasured and vacuum sealed to prevent spoilage. If bottle 10 is packaged with powdered formula, the user would add the specified amount of water as a diluter. Bottle 10 may also contain infant or toddler formula depending on the intended target market, and it may be sold individually or in a multiple bottle pack.

In addition to the releasably attached seal, bottle 10 and enclosure 16 may also include an anti-tamper ring 56. Anti-tamper ring 56 connects to a lower edge 58 of annular cap 36 by a plurality of relatively thin and frangible breakaway K tongues or webs 60. Internally, radially inwardly projecting and angularly extending ridges 57 are formed on an inner circumference of ring 56 which engage an under surface 61 of radially outwardly projecting flange 34. Thus, tensile forces rotationally fix anti-tamper ring 56 to flange 34 as annular cap 38 is unthreaded off bottle 10. As annular cap 38 is rotationally removed, both tensile and torsional forces acting on webs 60 cause the webs to sever allowing annular cap 38 and the vacuum seal to be completely removed.

Figure 5:
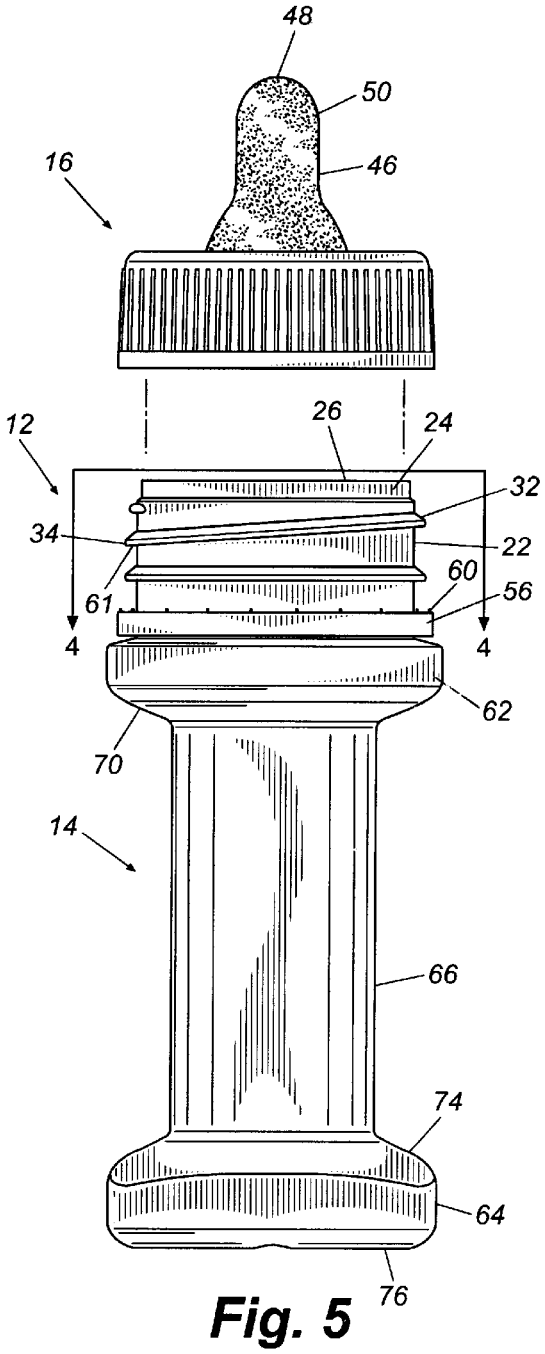
FIG. 5 is a right side elevational view of the baby bottle shown in FIG. 1, the left side elevational view being a mirror image of the right side.
Figure 6:
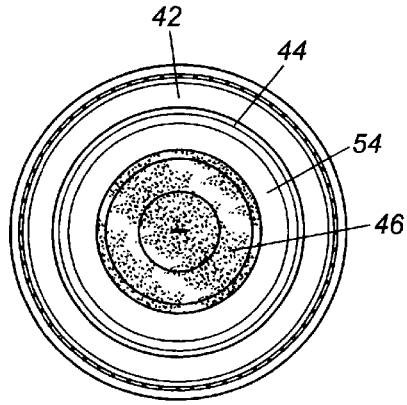
FIG. 6 is a top plan view of the baby bottle illustrated in FIG. 1.
Figure 9:
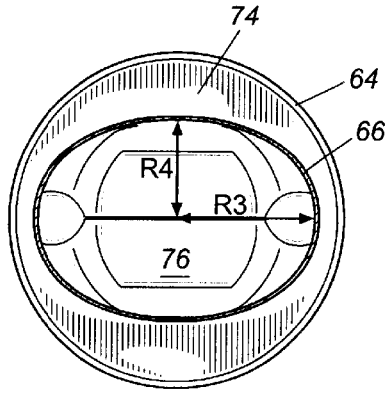
FIG. 9 is a cross-sectional view of the bottle in FIG. 2 looking down the central body portion.

Referring to FIGS. 2 and 5, body 14 comprises a generally cylindrical upper portion 62, a generally cylindrical lower portion 64, and a tubular body midsection 66 having a substantially elliptical cross-section as shown in FIG. 9. As clearly shown in FIGS. 3 and 4, the body is a tubular member that defines chamber 30 and has a central longitudinal axis 67.

Upper body portion 62 is located intermediate threaded cylindrical top portion 12 and body midsection 66, and it is in fluid communication with aperture 28 and chamber 30. Upper body portion 62 is tubular in shape and connects to top portion 12 by an inwardly sloping shoulder 68 and to central portion 66 by an outwardly sloping shoulder 70. A length of, for example, approximately ¼ inch and a radius R2 define cylindrical upper portion 62. Radius R2 is larger than radius R1 and may vary depending on the application of the bottle. The length of upper portion 62 may be larger or smaller depending on the volume of liquid held by bottle 10.

Figure 7:
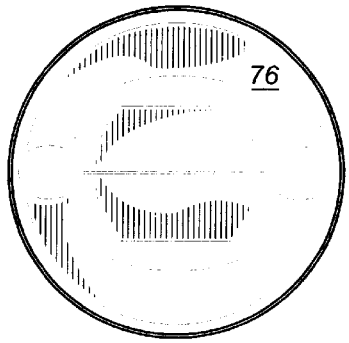
FIG. 7 is a bottom view of the baby bottle illustrated in FIG. 1.

Lower body portion 64 connects to body midsection 66 and defines a chamber 72, which is in fluid communication with chamber 30. Lower portion 64 has an axial length of, for example, approximately ¼ inch and a radius R5. As shown in FIG. 7, lower body portion 64 terminates in a circular base 76. Circular base 76 may be flat, or it may have a concave center portion allowing bottle 10 to stand upright. Lower portion 64 connects to body midsection 66 by an inwardly sloping shoulder 74. The length of lower portion 64 may be larger or smaller, but radius R5 is substantially equal to upper body portion radius R2. As will be appreciated by those skilled in the art, the fact that upper 62 and lower 64 portion each include a circular sidewall of substantially the same radius and centered about central longitudinal axis 67 enables bottle 10 to be readily molded and removed from the molding machine.

Figure 8:
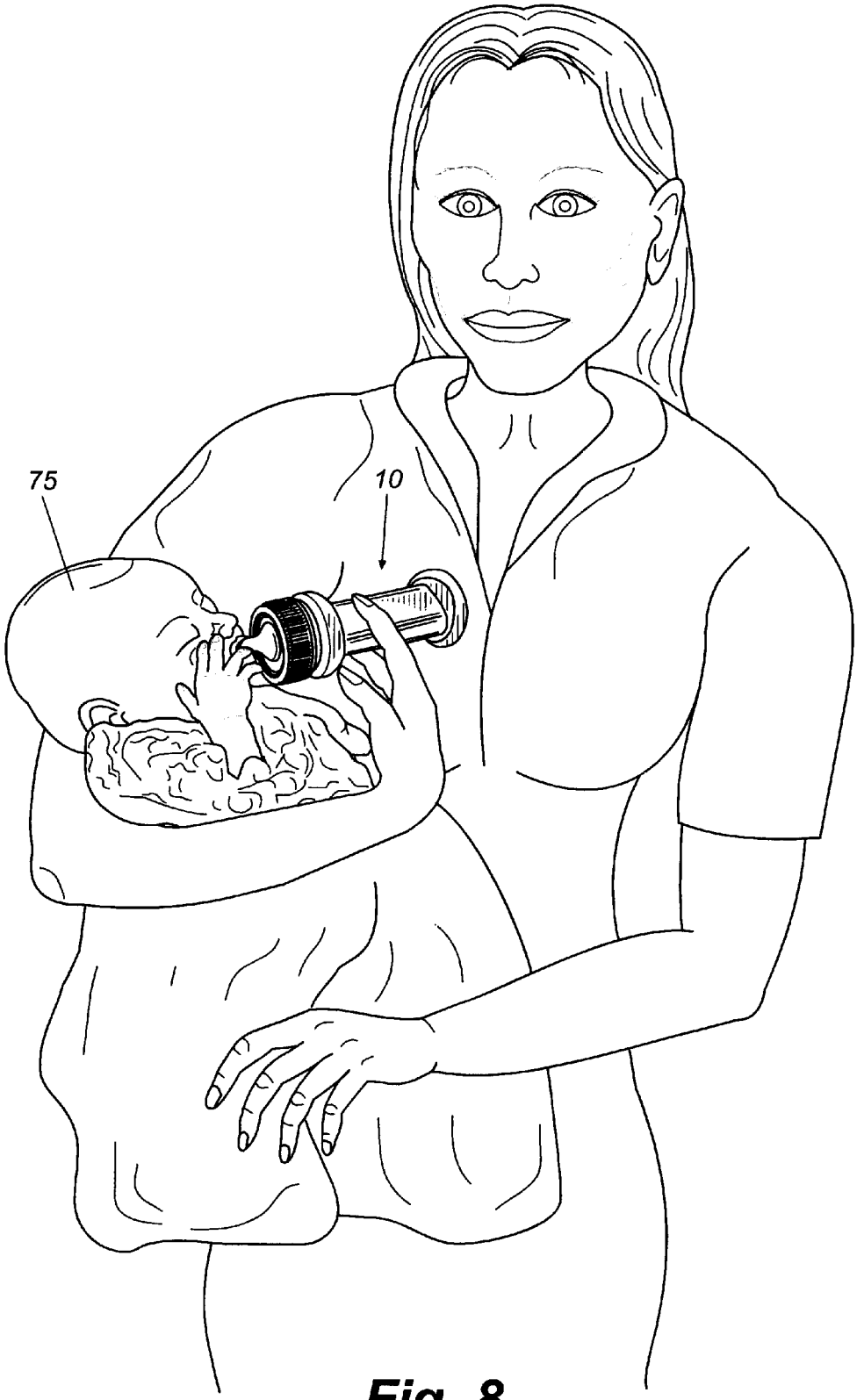
FIG. 8 is a perspective view of a caregiver illustrating the feeding of an infant while holding the bottle of FIG. 1 in the same hand as the infant.

As shown in FIG. 8, midsection 66 is constructed and sized to be held within the crook between fingers, such as the index and middle finger, of a person holding bottle 10 when feeding an infant 75. To that end, body midsection 66 is elliptical in shape (FIG. 9) and has a major axis radius of R3 and a minor axis radius of R4. The axial length of midsection 66 is approximately 2¼ inches and may vary depending on the volume of liquid to be carried in bottle 10. Major axis radius R3 is substantially equal to threaded top portion radius R1, but it is smaller than upper body portion radius R2 and lower body portion radius R5. Minor axis radius R4 is substantially smaller than radii R1, R2, R3, and R5.

An elliptical shaped midsection is advantageous over a circular shaped midsection. First, it ensures that midsection 66 is sufficiently narrow enabling a caregiver to comfortably hold bottle 10. Furthermore, an elliptical cylindrical midsection holds a larger quantity of formula than a bottle having a circular cylindrical midsection having a radius substantially equal to the minor axis radius R4. In addition, an elliptical shaped midsection provides a larger area for labeling the bottle.

Turning to FIG. 2, it can be seen that front surface 77 of body midsection 66 may be provided with indicia 78, wherein indicia 78 register the fluid content of bottle 10 in an upright position. A second set of indicia 80 may be included on the front surface of body midsection 66. Indicia 80 register the remaining fluid content in the inverted feeding position so that these visual indicia will be readily available to the caregiver during feedings. One of ordinary skill in the art would understand that the range of measurements differ between the upright and inverted positions due to the volume of liquid held in threaded cylindrical top portion 12.

In a second embodiment, bottle 10 does not include nipple 46 press fit into annular cap 38 as described above. Instead, a substantially flat circular disc (not shown) located proximate the under surface of annular end wall 42 forms a liquid-tight seal when closure 16 is removably secured to threaded cylindrical portion 12. The disc should have an outer radius substantially equal to an inner radius of annular cap 38. Therefore, as the caregiver tightens annular cap 38 on cylindrical portion 12, rim 26 and the bottom surface of annular end wall 44 compress the disc to establish the liquid-tight seal. The disc may comprise aluminum annular shaped material bonded to a compressible annular shaped material formed, for example, from conventional rubber, silicone rubber, or other suitable compositions. In this embodiment, use of the compressible disc eliminates the need for a separate removable vacuum seal. However, for safety concerns, bottle 10 can be packaged using an independent safety seal and anti-tampering ring in addition to the compressible disc.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims. Therefore, the spirit and scope of the appended claims should not be limited to the description of the preferred versions contained therein.

What we claim is:

1. A baby bottle comprising:

a. a circular shaped cylindrical upper body portion having a first radius perpendicular to a central longitudinal axis;

b. a circular shaped cylindrical lower body portion having a second radius perpendicular to said central longitudinal axis, an open top, and a circular base; and c. an elliptical shaped cylindrical body portion intermediate said circular shaped cylindrical upper and lower body portions, said elliptical body portion including a minor axis radius and a major axis radius each perpendicular to said central longitudinal axis, wherein said major and minor axis radii are smaller than said first and said second radius.

2. The baby bottle in claim 1, said bottle further comprising a cylindrical top portion adapted to removably receive a closure.

3. The baby bottle in claim 2, said bottle further comprising a closure.

4. The baby bottle in claim 3, said cylindrical top portion further comprising:

a. a first helical thread formed on an outer circumference of said cylindrical top portion;

b. a top rim portion; and c. an annular flange formed on said outer circumference of said cylindrical top portion and located axially below said first helical thread.

5. The baby bottle in claim 4, said bottle further comprising an anti-tamper ring, said ring being removably attached by a plurality of frangible breakaway tongues to a bottom rim of said closure.

6. The baby bottle in claim 5, said ring further comprising radially inwardly extending ridges for engaging a bottom surface of said annular flange, wherein said ring removably secures said closure to said cylindrical top portion.

7. The baby bottle in claim 6, said closure further comprising:

a. an annular cap, said cap comprising,
an annular end wall defining an aperture therein, and
a second helical thread formed on an inner circumference of said annular cap, and b. an annular disc press fitable to a bottom surface of said annular end wall, wherein the radius of said disc is substantially equal to an inner radius of said annular cap, and wherein an outer edge portion of said disc is compressible between a bottom surface of said annular end wall and said top rim portion as said annular cap is threadably received by said cylindrical top portion to form a liquid-tight seal.

8. The baby bottle in claim 6, said closure further comprising:

a. an annular cap, said cap comprising,
an annular end wall defining an aperture therein, and
a second helical thread formed on an inner circumference of said annular cap, and b. a nipple press fitable to a bottom surface of said annular end wall and extending through said aperture, wherein said second thread is adapted to receive said first thread for removably receiving said annular cap onto said cylindrical top portion.

9. The baby bottle in claim 8, said nipple further comprising a radially extending annular flange having an outer radius substantially equal to the inner radius of said annular cap, wherein said radially extending annular flange is compressible between the bottom surface of said annular end wall and said top rim portion as said annular cap is threadably received by said cylindrical top portion to form a liquid-tight seal.

10. The baby bottle in claim 1, wherein said first radius and said second radius are substantially equal.

11. A baby bottle comprising:

a. a cylindrical top portion adapted to removably receive a closure, said top portion having a circular upper rim portion defining a mouth;

b. a circular shaped cylindrical upper body portion having a first radius, said circular shaped cylindrical upper body portion integrally formed with said cylindrical top portion;

c. a circular shaped cylindrical lower body portion having a second radius;

d. an elliptical shaped cylindrical body portion intermediate said circular shaped cylindrical upper and lower body portions and in fluid communication with said mouth, said elliptical shaped body portion including a minor axis and a major axis radius, wherein said minor axis radius is smaller than said first radius; and e. a closure removably received on said cylindrical top portion.

12. The baby bottle in claim 11, said bottle further comprising a removably attached safety seal over said mouth and to said circular upper rim portion.

13. The baby bottle in claim 12, said cylindrical top portion further comprising:

a. a first helical thread formed on an outer circumference of said cylindrical top portion; and b. an annular flange formed on said outer circumference of said cylindrical top portion and located axially below said first helical thread.

14. The baby bottle in claim 13, said closure further comprising:

a. an annular cap, said cap comprising,
an annular end wall defining an aperture therein, and
a second helical thread formed on an inner circumference of said annular cap, and b. a disc press fitable to the bottom surface of said annular end wall, wherein the radius of said disc is substantially equal to an inner radius of said annular cap, and wherein an outer edge portion of said disc is compressible between a bottom surface of said annular end wall and said top rim portion as said annular cap is threadably received by said cylindrical top portion to form a liquid-tight seal.

15. The baby bottle in claim 14, said bottle further comprising a nipple having a radially extending annular flange with an outer radius substantially equal to the inner radius of said annular cap, wherein said disc is removable from said annular cap and said nipple is press fitable into said annular cap, whereby said annular flange is compressible between the bottom surface of said annular end wall and said upper rim portion as said annular cap is threadably received by said cylindrical top portion to form a liquid-tight seal.

16. A baby bottle comprising:

a. a cylindrical top portion adapted to receive a closure and comprising:
a first helical thread formed on an outer circumference;
an annular flange located proximate said threads; and
a circular upper rim defining a mouth, b. a circular shaped cylindrical upper body portion having a first radius;

c. a circular shaped cylindrical lower body portion having a second radius;

d. an elliptical shaped cylindrical body portion intermediate said circular shaped cylindrical upper and lower body portions, said elliptical shaped body portion including a minor axis and a major axis radius, wherein said minor axis radius is smaller than said first and said second radius.

17. The baby bottle in claim 16, said bottle further comprising a closure removably received on said cylindrical top portion.

18. The baby bottle in claim 17, said bottle further comprising an anti-tamper ring, said ring being removably attached to a bottom rim of said closure by a plurality of frangible breakaway tongues.

19. The baby bottle in claim 18, said ring further comprising radially inwardly extending ridges for engaging a bottom surface of said annular flange, wherein said ring removably secures said closure to said bottle.

20. The baby bottle in claim 17, said closure further comprising:

a. an annular cap, said cap comprising,
an annular end wall defining an aperture therein, and
a second helical thread formed on an inner circumference of said annular cap, and b. a nipple press fitable to the bottom surface of said annular end wall and extending through said aperture, wherein said second thread is adapted to receive said first thread for removably receiving said annular cap onto said cylindrical top portion.

21. The baby bottle in claim 20, said closure further including an annular cap including, a. a cylindrical side wall, and b. a circular top portion, wherein a helical thread is formed on an inner circumference of said cylindrical wall.

22. The baby bottle in claim 21, said bottle further comprising a removably attached safety seal attached over said mouth to said upper rim portion.

23. A baby bottle comprising:

a. a cylindrical top portion adapted to removably receive a closure, said top portion having a circular upper rim portion defining a mouth;

b. a circular shaped cylindrical upper body portion having a first radius, said circular shaped cylindrical upper body portion integrally formed with said cylindrical top portion;

c. a circular shaped cylindrical lower body portion having a second radius;

d. an elliptical shaped cylindrical body portion intermediate said circular shaped cylindrical upper and lower body portions and in fluid communication with said mouth, said elliptical shaped body portion including a minor axis and a major axis radius, wherein said minor axis radius is smaller than said first radius; and e. formula contained within the bottle.

24. The baby bottle in claim 23, said bottle further comprising a removably attached safety seal over said mouth and to said circular upper rim portion.

25. The baby bottle in claim 24, said cylindrical top portion further comprising:

a. a first helical thread formed on an outer circumference of said cylindrical top portion; and b. an annular flange formed on said outer circumference of said cylindrical top portion and located axially below said first helical thread.

26. The baby bottle in claim 25, said closure further comprising an annular cap adapted to be received by said cylindrical top portion.

* * * * *